US006484503B1

(12) United States Patent
Raz

(10) Patent No.: US 6,484,503 B1
(45) Date of Patent: Nov. 26, 2002

(54) COMPRESSION AND CONDENSATION OF TURBINE EXHAUST STEAM

(76) Inventor: Arie Raz, 66 Saifan Street, Ramat Hasharon 47248 (IL)

( * ) Notice: Subject to any disclaimer, the term of this patent is extended or adjusted under 35 U.S.C. 154(b) by 128 days.

(21) Appl. No.: 09/635,366

(22) Filed: Aug. 9, 2000

Related U.S. Application Data

(60) Provisional application No. 60/175,666, filed on Jan. 12, 2000.

(51) Int. Cl.[7] ..... F01B 31/16

(52) U.S. Cl. ..... 60/685; 60/686; 60/688

(58) Field of Search ..... 60/645, 648, 670, 60/677, 681, 685, 686, 690, 692, 688

(56) References Cited

U.S. PATENT DOCUMENTS

| | | | | |
|---|---|---|---|---|
| 1,790,154 A | * | 1/1931 | Kasley | 60/677 X |
| 2,955,429 A | * | 10/1960 | Miller | 60/677 X |
| 3,338,052 A | | 8/1967 | Holden | 60/95 |
| 3,820,334 A | | 6/1974 | Heller et al. | 60/688 |
| 3,835,650 A | | 9/1974 | Chesmejef | 60/690 |
| 3,982,379 A | * | 9/1976 | Gilli et al. | 60/677 X |
| 4,164,848 A | * | 8/1979 | Gilli et al. | 60/677 X |
| 4,306,418 A | | 12/1981 | Nishioka | 60/693 |
| 4,434,620 A | | 3/1984 | Ishimaru et al. | 60/657 |
| 4,506,508 A | | 3/1985 | Coers et al. | 60/652 |
| 4,767,263 A | | 8/1988 | Ayano et al. | 415/121 A |
| 4,799,356 A | * | 1/1989 | Doering | 60/677 X |
| 5,131,230 A | | 7/1992 | Barton et al. | 60/646 |
| 5,136,848 A | | 8/1992 | Silvestri, Jr. | 60/646 |
| 5,167,123 A | | 12/1992 | Brandon | 69/690 |
| 5,426,941 A | | 6/1995 | Lewis | 60/693 |
| 5,575,244 A | | 11/1996 | Dethier | 122/406.1 |
| 6,003,298 A | * | 12/1999 | Horner | 60/39.182 |

FOREIGN PATENT DOCUMENTS

| | | | |
|---|---|---|---|
| WO | WO 99/09300 | 2/1999 | F01B/31/00 |

* cited by examiner

*Primary Examiner*—Hoang Nguyen

(57) ABSTRACT

The invention consists a dual section vessel including a first section being a turbine exhaust steam enclosure and a second section being a condensate water vessel accumulation, both sections being connected by a system of water columns. The system of water columns comprising moderate diffusers for retaining turbine exhaust steam velocity without increasing in pressure, towards impact with cold recirculated condensate water. The recirculated warm condensate water from the condensate water vessel flows through a counter current heat exchanger, and as cold condensate water to dispersion pipes connected to the ends of the diffusers. This complete system is arranged for receiving, compressing and condensing the exhaust steam from the turbine last stage. From the collision location the exhaust steam and condensate water continue to flow as "two phase flow" downward to the "condensate water vessel." In the water columns the continuous flow produces a lower pressure in the top of the column than the pressure in the bottom. The inclusion of a "counter current heat exchanger" assures a very low difference between the cooling media inlet temperature and the exiting recirculated condensate water, and a correspondingly significant reduction of the turbine exhaust steam temperature.

5 Claims, 2 Drawing Sheets

30
28
1
2
3
4
5
6
7
8
9
10
11
12
13
14
15
16
17

COMPRESSION AND CONDENSATION OF TURBINE EXHAUST STEAM

This application claims the benefit of provisional application 6,175,666 filed Jan. 12, 2000

FIELD OF THE INVENTION

The present invention is related generally to compression and condensation of turbine exhaust steam, and particularly to reducing the temperature difference between the inlet of a cooling medium (e.g., sea water or fresh water) in a counter current heat exchanger and the temperature of the turbine exhaust steam. The invention is a new "condenser system" which will replace conventional condensers normally utilized in power plants.

BACKGROUND OF THE INVENTION

A steam turbine is a well-known device for converting a heated gas (in this case steam) into either mechanical or electrical energy, depending upon the driven device. In the heat/power cycle of the turbine, steam enters the turbine at elevated pressure and temperature, and the inherent heat energy of the steam is converted into rotational energy.

The generally accepted heat/power cycle for central power station units requires the turbine discharge exhaust pressure to be as low as possible—i.e. high vacuum. The high vacuum is intended to maximize the removal of available energy per unit mass of steam, thereby maximizing the thermodynamic efficiency from the steam turbine.

A condenser, generally a shell and tube heat exchanger, is located at the steam exit of the turbine to condense the turbine discharge steam flow for its reuse as a condensate in the heat power cycle. The cooling medium, either sea or fresh water, passes through the tubes while the exiting steam condenses within the condenser shell on the exterior surface of the tubes, ultimately falling to the bottom of the condenser for reuse in the heat power cycle.

In the current power plant state-of-the-art, large power station units are equipped with two identical low pressure double flow turbines which operate in parallel. In effect, the low pressure steam flow is divided into four parallel flows exiting four last-stage turbines, at approximately 300 m/sec.

Prior art low pressure turbine exhaust shell designs are generally inefficient, since the existing designs produce an excessive pressure drop in the exhaust steam flow, caused by obstructions in the steam path in combination with a lack of proper steam ducting to the condenser which creates undesirable swirling and a decrease in system efficiency.

SUMMARY OF THE INVENTION

The present invention provides a system for compression and condensation of turbine exhaust steam in combination with a counter current heat exchanger using sea water or fresh water or air as the cooling medium, which increases the power output of the steam turbine.

The system causes an increase in vacuum at the turbine exhaust, which in turn produces an incremental increase in the rotational energy extracted from the low pressure section of the turbines, due to a reduction in the temperature difference between the inlet of the cooling medium and the temperature of the exhaust steam, making the system very efficient.

There is thus provided in accordance with a preferred embodiment of the present invention a steam turbine exhaust system comprising a dual section vessel including a first section being a turbine exhaust steam enclosure and a second section being a condensate water vessel, both sections being connected by a system of water columns.

The system of water columns comprising moderate diffusers for retaining turbine steam velocity without increase in pressure, towards impact with the water columns, and an integral condensate recirculation connection having one end immersed in the condensate water vessel for collecting warm condensate water and transporting to a counter current heat exchanger.

Further, in accordance with a preferred embodiment of the present invention a counter current heat exchanger is provided through which the recirculated condensate water is cooled and recirculated.

The heat exchanger controlling the temperature of the condensate, so that the condensate exit temperature being within a small temperature difference to a cooling medium through the heat exchanger, then returning the condensate at the reduced temperature for distributing through water dispersion pipes connected to the ends of the diffusers.

At the colliding location, between exhaust steam and condensate water, the exhaust steam continues to flow as "two phase flow," where the steam being compressed and simultaneously condensed produces an incrementally lower exhaust steam temperature and higher vacuum at the exhaust of the last stage turbine. This vacuum being incrementally higher than the condensate water vessel vacuum due to a rise in condensate temperature during its downward flow in the water columns.

Still, further in accordance with a preferred embodiment of the present invention, ends of the diffusers are immersed sufficiently in the condensate water so that a majority of a height of the water columns is in the ends of the diffusers, and the ends of the diffusers are arranged for receiving, compressing and condensing the exhaust steam from the last turbine stage, colliding with a cold condensate.

Preferably temperatures are generally uniform on top portion of the water columns.

Still further, in accordance with a preferred embodiment of the present invention the diffusers are sufficiently moderate so as to maintain an almost constant steam velocity until the exhaust steam is close to impact with the water columns. After the turbine neck, the diffusers are preferably enveloped up to the condensate water vessel.

A steam turbine exhaust system, wherein at least one of the said water columns downstream of one of said diffusers having integral connection for recirculating cold condensate, said water columns being inmmersed in the lower portion of said condensate water vessel.

Still further, in accordance with a preferred embodiment of the present invention, a second such steam turbine exhaust system is provided, wherein turbine exhaust steam exits from the first steam turbine exhaust system, collides with recirculated condensate water, flows to the second steam turbine exhaust system and collides with water columns of the second steam turbine exhaust system which results in double compression with a corresponding increase in condensate temperature.

BRIEF DESCRIPTION OF DRAWINGS

The present invention will be understood and appreciated more fully from the following detailed description, taken in conjunction with the drawings in which.

DETAILED DESCRIPTION OF A PREFERRED EMBODIMENT

Figure 1:
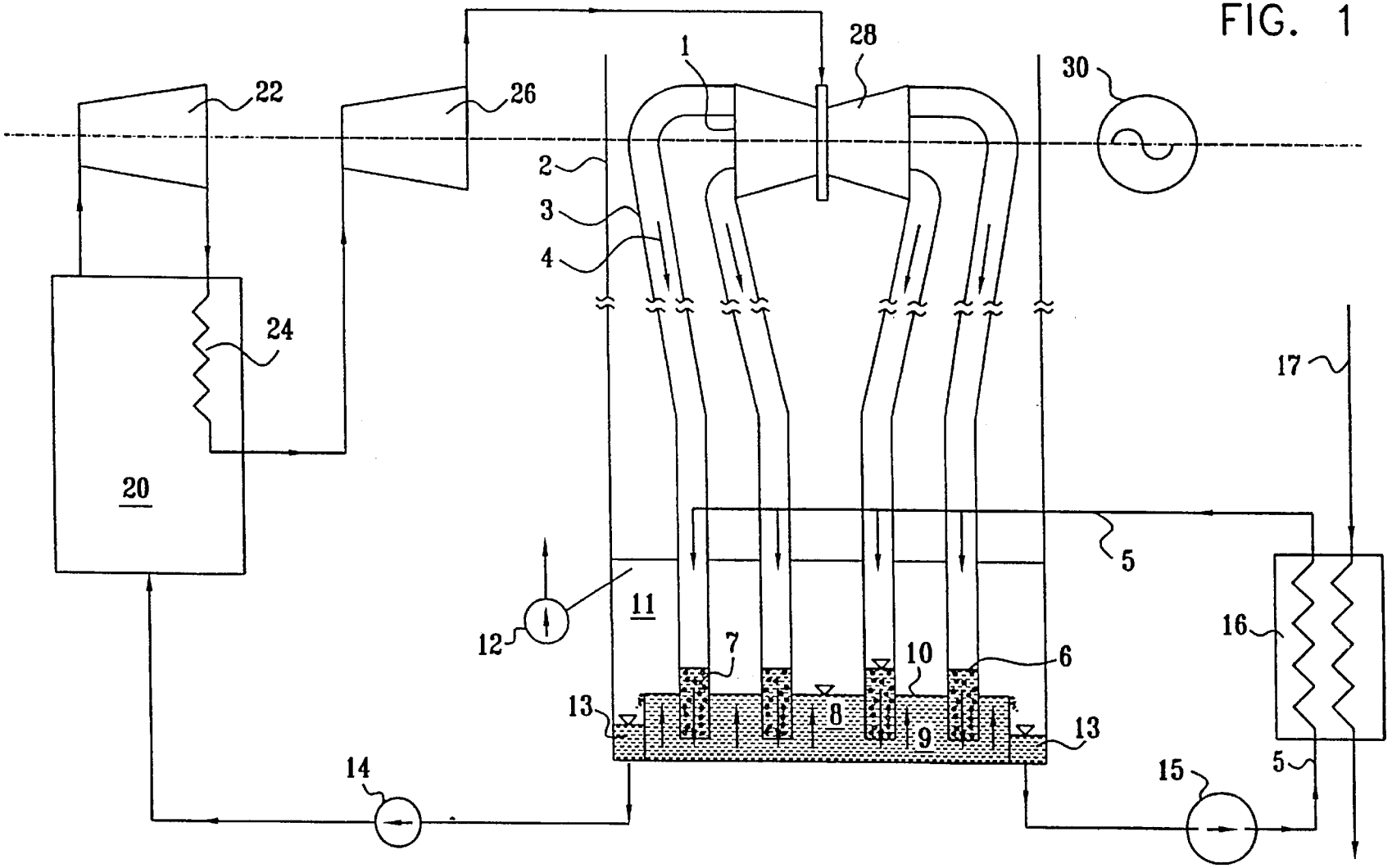
FIG. 1 is a simplified illustration of a steam turbine exhaust system constructed in accordance with a preferred embodiment of the present invention, wherein the system is single stage.

Reference is now made to FIG. 1 which illustrates a steam turbine exhaust system constructed in accordance with a preferred embodiment of the present invention.

A low pressure turbine exhaust hood 2 is preferably provided, which is an exterior envelope of a low pressure turbine shell. To assure minimum losses in the turbine exhaust hood 2, multiple diffusers 3 are preferably placed between the last turbine stage 1 and the system of water columns 7. Preferably, the diffusers 3 are very moderate as to maintain almost constant steam velocity until the steam is close to impact with the water columns.

In general, diffusers have not been placed between the last stage of the turbine and the condensers in the prior art due to various problems. For example, temperature conditions at the end of the diffusers along the length of the condenser have been known to produce instability at the last stage of the turbine.

Usually, in the design of power stations, the purpose of diffusing is not to maintain velocity but rather to increase pressure. In contrast, in the present invention, the intention of diffusing is to retain steam velocity, without increasing pressure, towards impact with water columns 7.

The condensate water preferably accumulates in condensate water vessel 8. The ends of diffusers 3 are preferably immersed sufficiently in the condensate water so that the majority of the height of water columns 7 is in the ends of diffusers 3.

The mixed flow of the exhaust steam 4 colliding with the recirculated condensate water 5 in the end of diffusers 3, collides with the condensate water of water columns 7. The system of water columns 7 receive, compress and condense the turbine exhaust steam 4, and the two phase flow (i.e., steam plus condensate) assures a higher stagnation pressure which produces a higher increase of compression. Temperatures are preferably generally uniform everywhere on top portions 6 of water columns 7, which facilitate the implementation of diffusers 3.

The use of diffusers 3 produces a relatively small increase in power output due to a reduction in exhaust hood 2 losses, while assuring a maximum velocity of turbine exhaust steam 4 before impact with water columns 7, and as a result, a deeper compression is achieved.

The first collision between the exhaust system and the cold condensate water spray brings a certain increase in pressure and a certain condensation, which determines the temperature (the pressure) of the turbine exhaust steam.

The stagnation pressure magnitude, changes at any point from the first impact between the exhaust steam and the cold condensate water spray down to the condensate water vessel.

From the turbine exit, down to the condensate water vessel, the steam velocity will always be greater than the water velocity. The steam bubbles collide with the water droplets along the "water column" down to the condensate water vessel. The temperature and the pressure increase progressively and the stagnation pressure at every point along the "water column" is sufficiently high to increase the pressure and to make possible condensation in every new condition. Towards the end of the process, sudden increase in pressure and an attendant sudden condensation will occur.

In a typical system, the condensate water temperature due to vapor compression will be a few degrees Celsius above the cold recirculating condensate temperature.

The condensate water flow from water columns 7 is preferably physically retained by condensate water vessel 8, until the water column pressure is sufficient to push the condensate over a spill level 10. The over flow (preferably laminar) along the outside wall of the interior of vessel 8 assures efficient non-condensable degassing. Non-condensables are preferably extracted from an upper closed space 11 of vessel 8 with a vacuum pump 12 and ejected to the atmosphere.

The majority of the total condensate water, designated by reference numeral 13, is preferably recirculated by a recirculation pump 15, through a heat exchanger 16. Heat exchanger 16 is preferably a counter current heat exchanger, which is cooled by sea or fresh water. This type of heat exchanger achieves a small temperature difference between the recirculating condensate 5 and inlet sea water 17.

A smaller portion of the total condensate water, equal to the turbine exhaust steam rate, is preferably returned by a condensate pump 14 to the heat power cycle, comprising various heat exchangers and associated booster pumps (not shown), ultimately to a boiler 20 which produces steam to drive turbine 28 and a generator 30.

The steam flows from boiler 20 to a high pressure turbine 22, returns to be reheated (reference numeral 24) in boiler 20, and flows to an intermediate pressure turbine 26. The steam then flows through turbine 26 to the low pressure turbine 28. As seen in FIG. 1, the cooled recirculating condensate 5 returns to the ends of diffusers 3, where together with exhaust steam 4, they once again collide with condensate water columns 7, and the process is repeated.

The integration of a counter current heat exchanger in a steam power station cooling system is worthwhile, if one can compress and condense the turbine exhaust steam 4 before entering the cooling heat exchanger 16. As described hereinabove, the present invention achieves this goal. The system of the present invention causes an increase in vacuum at the turbine exhaust, which in turn produces an incremental increase in the rotational energy extracted from the low pressure section of the turbines. This achieves the very desirable goal of reducing the temperature difference between the inlet of the cooling medium (e.g., sea water or fresh water) and the temperature of the exhaust steam 4 of the low pressure turbine 28, making the system very efficient.

The increased exhaust shall vacuum of the system described hereinabove substantially increases the steam specific volume and exiting velocity from the low pressure turbine last stage 1. In accordance with a preferred embodiment of the present invention, a wheel can be added to each last stage section of the low pressure rotor or rotors of turbine 28, in order to diminish this increase in the steam specific volume and exiting velocity.

Figure 2:
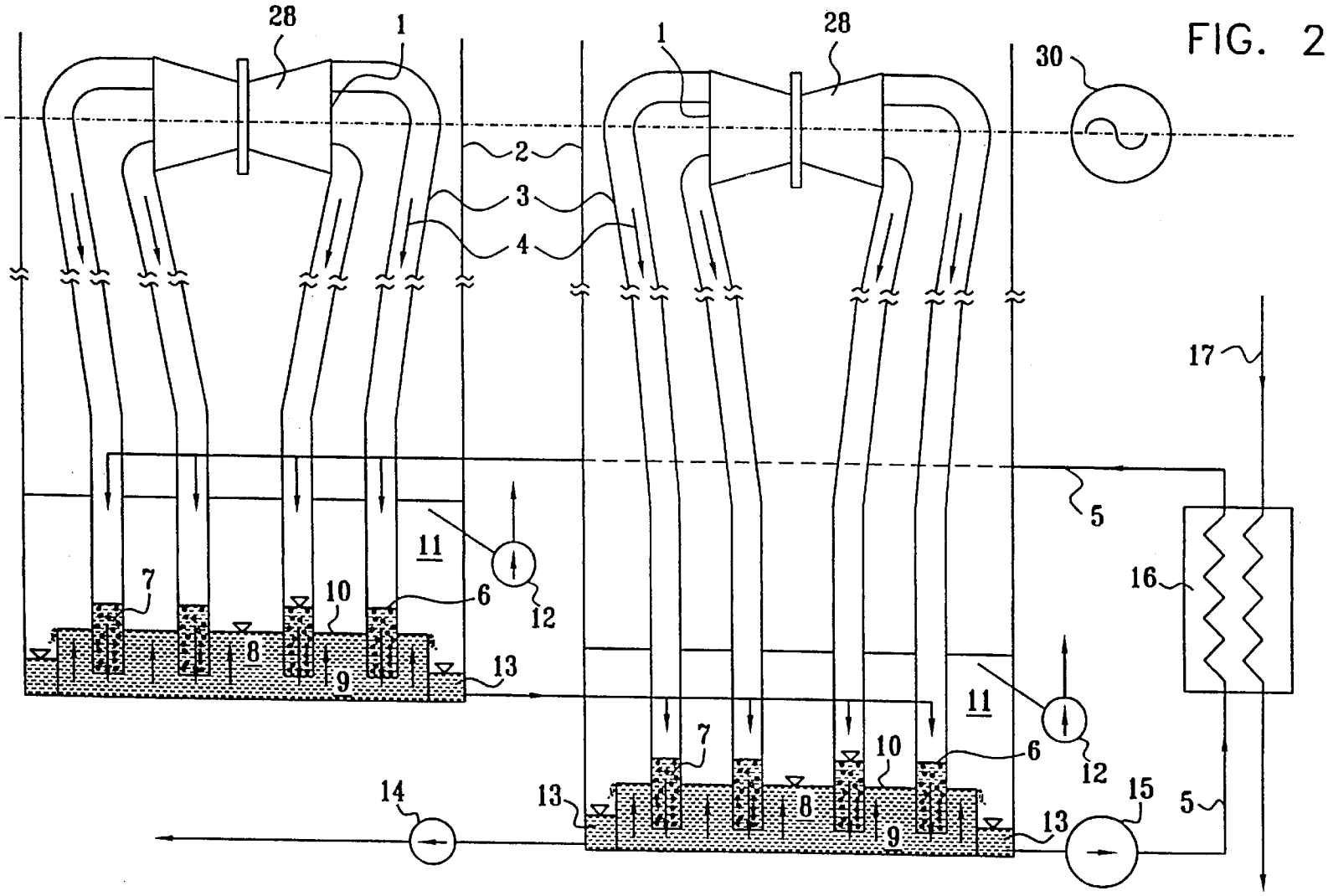
FIG. 2 is a simplified illustration of a steam turbine exhaust system constructed in accordance with another preferred embodiment of the present invention, wherein the system is two-stage.

Reference is now made to FIG. 2, which illustrates a different version of the steam turbine exhaust system, constructed in accordance with another preferred embodiment of the present invention. In the embodiment of FIG. 2, compression and condensing of the steam is done in two stages. Turbine exhaust steam 4 is preferably compressed at each low pressure turbine exhaust, and the total compression is the sum of the compression within both shells 2.

The system of FIG. 2 preferably operates as similarly described hereinabove with reference to FIG. 1, except that in the system of FIG. 2 turbine exhaust steam 4 exits from two preferably identical low pressure turbines 28 and recycled condensate 5 collides with the first stage of exhaust steam 4 just above the condensate water columns 7 of the first stage. The final mixed fluid temperature at the bottom portion 9 of the first stage is a function of the depth of compression and the rise in coolant temperature resulting from the removal of heat of vaporization (latent heat) from the turbine exhaust steam 4. In a typical system, the condensate water temperature due to vapor compression will be at least half the increase as that of FIG. 1.

Afterwards the recirculated condensate water flows by gravitation from the first stage to the second stage, and collides with the water columns 7 of the second stage. The second low pressure turbine exhaust steam 4 typically increases the temperature of the condensate in the second stage by half the increase as that of FIG. 1, by the action of compression and condensation described hereinabove for the first stage.

The majority of the total condensate water from the second stage is recirculated by recirculation pump 15 through heat exchanger 16. The small part of the condensate water is returned by condensate pump 14 to the heat power cycle, as described hereinabove. The cooled recirculating, condensate 5 returns to the top of the water columns 7 of the first stage, where, together with the turbine exhaust steam 4, they once again collide with water columns 7, and the process is repeated.

It is appreciated that a combine cycle (gas turbine with steam turbine) can incorporate the system of the present invention, especially with an air cooling tower.

The invention will reduce the temperature of the turbine exhaust steam at the turbine last stage.

Due to the relatively high temperate of the cooling air, reducing the turbine exhaust steam temperature is very important. In the large "combined cycle units," usually the exhaust steam of the steam turbine is cooled by a dry cooling tower. An additional advantage is that the "combined cycle" requires a large capacity recirculation pump similar to the invention process, therefore both processes may use together one pump.

What is claimed is:

1. A steam turbine exhaust system comprising:

a dual section vessel including a first section being a turbine exhaust steam enclosure and a second section being a condensate water vessel accumulation, said sections being connected by a system of water columns, said system of water columns comprising at least one very moderate diffuser for retaining turbine steam velocity without increase in pressure, towards impact with the water columns, an integral condensate recirculation connection having one end immersed in said condensate water vessel for collecting warm condensate water and transporting to a counter-current heat exchanger, the heat exchanger controlling the temperature of the condensate so that the condensate exit temperature being within a small temperature difference to a cooling medium through the heat exchanger, then returning the condensate at the reduced temperature for distributing through water dispersion pipes connected to the ends of the diffusers, said ends of the diffusers are arranged for receiving, compressing and condensing a turbine exhaust steam from the last turbine stage, colliding with a cold condensate, at the colliding location, the exhaust steam continues to flow as two phase flow, where the steam being compressed and simultaneously condensed and producing an incrementally lower exhaust steam temperature and higher vacuum at the exhaust of a turbine last stage, said vacuum being incrementally higher than a condensate water vessel vacuum which results from the rise in condensate temperature during its downward flow in the water columns.

2. A steam turbine exhaust system in accordance with claim 1, wherein laminar overflow of condensate are permitted along outside walls of water seals at the bottom of the water column so that efficient non-condensable degassing is accomplished inside the condensate water vessel.

3. A steam turbine exhaust system in accordance with claim 1, wherein said exhaust system being used in combined cycles having dry cooling towers.

4. A steam turbine exhaust system in accordance with claim 1, wherein two of said exhaust system are included and arranged in series for doubling compression with a corresponding increase in condensate temperature.

5. A steam turbine exhaust system in accordance with claim 1, wherein at least one of the said water columns downstream of one of said diffusers having integral connection for recirculating cold condensate, said water columns being immersed in the lower portion of said condensate water vessel.

* * * * *